US005127207A

United States Patent [19]

Cunningham

[11] Patent Number: 5,127,207

[45] Date of Patent: Jul. 7, 1992

[54] CASE BLANK FEED DEVICE

[76] Inventor: Thomas J. Cunningham, 11120 Rotherick Dr., Alpharetta, Ga. 30302

[21] Appl. No.: 649,580

[22] Filed: Feb. 1, 1991

[51] Int. Cl.[5] ..... B65B 43/18; B65H 3/12

[52] U.S. Cl. ..... 53/396; 53/389.1; 271/102; 414/797.8; 414/923

[58] Field of Search ..... 53/564, 566, 571, 389.1, 53/389.4, 458, 396; 271/99, 101, 102, 106; 493/122, 123, 315, 316; 414/797.8, 796.9, 797, 797.9, 797.6, 923

[56] References Cited

U.S. PATENT DOCUMENTS

| | | | |
|---|---|---|---|
| 920,154 | 5/1909 | Kent | 271/102 |
| 1,292,641 | 1/1919 | Pedrick | 271/106 |
| 1,787,077 | 12/1930 | Kruse | 271/102 |
| 2,378,306 | 6/1945 | Leonhart | 271/102 X |
| 3,482,372 | 12/1969 | Hottendorf . | |
| 3,960,373 | 6/1976 | Pacholok | 271/102 X |
| 4,033,096 | 7/1977 | Burgat et al. | 53/571 X |
| 4,250,693 | 2/1981 | Andersson . | |
| 4,359,214 | 11/1982 | Eldridge . | |
| 5,027,586 | 7/1991 | Ramaker | 53/566 X |

*Primary Examiner*—Horace M. Culver
*Attorney, Agent, or Firm*—Jones, Askew & Lunsford

[57] ABSTRACT

A case blank feed device used in case packaging assemblies is disclosed. The device employs a pair of parallel and spaced apart bars rotatably mounted at the bottom of a case blank container having a stack of case blanks. As the bottom blank is pulled from the bottom of the container, the roller bars decrease the friction associated with the weight of the stack. In addition, the blank feed device concentrates the vacuum force along the blank edges located parallel and proximate to the roller bars so that deflection of the blank is minimized.

8 Claims, 7 Drawing Sheets

CASE BLANK FEED DEVICE

TECHNICAL FIELD

The present invention relates to an improved blank feed device used in packaging assemblies, and in particular relates to a device that contains case blanks within a packaging assembly line and removes the bottom case blank from a stack of case blanks.

BACKGROUND OF THE INVENTION

The packaging industry today is almost entirely automated. For manufactures of packaged items, an automated packaging process is quicker, less expensive and safer than its manual counterpart.

A typical automated case packaging assembly includes a collator feeder of items to be packaged, a case blank feed device, a case folding device, a case advance section and a compression area. The collator arranges the items to be packaged and transfers them to the folding device. At the same time, a case blank feed device pulls a flat pre-cut case blank from a stack of case blanks and transfers it to the folding device. The blank is set in place and receives the items for packaging. The folding device partially folds the case blank around the items to form the case and transfers the case to the case advance section. The case advance section applies adhesive and provides the final folding to the case. The case then enters the compression section where it is compressed either vertically or horizontally before it is stacked and ready for shipping.

A case blank feed device is designed to contain a plurality of pre-cut case blanks and singularly feed them into a folding device. In the past, case blank feed devices were designed to contain a vertical stack of case blanks where the stack of blanks rested on a series of fixed tabs or lips. A single case blank was transferred by means of a single suction force applied to the underside of the bottom most blank in the stack. The suction force would pull the blank downward far enough to cause the blank to deflect and clear the fixed lips or tabs.

This method and structure have proved to be ineffective. The use of fixed tabs to support a stack of case blanks requires the use of considerable force to remove the bottom blank from the stack. The force must overcome the friction created by the fixed structure coupled with the weight of the stack. As the stack weight increases, the friction increases and thus more force is needed to remove the bottom blank.

In addition to the problems related to the structure of case blank feed devices, previous blank feed removal methods have been found to be ineffective and costly. In the past, a single vacuum force was applied to the underside center of the bottom blank in a stack of blanks contained in a structure having an open bottom. The single application of vacuum force is ineffective because it requires the blank to significantly deflect from the center of the blank. This deflection also requires the blank to travel downward a considerable distance before the blank clears the tabs. The extensive deflection and considerable downward travel by the blank frequently causes the blank to partially clear the fixed lips or tabs which results in jamming the entire process.

Due to the previous blank feed removal methods, prior blank feed devices had to be designed so as to limit the number of blanks in a stack. Because the friction created by the stack weight against the fixed structure is high, the stack weight had to be minimized in order for the vacuum force to effectively remove a blank. Consequently, a smaller stack height required blanks be added to the stack at more frequent intervals. This required manual feeding and additional downtime if the stack was completely depleted before more blanks were added. Closer attention to the blank feed device and more frequent down time resulted in productivity losses for the entire packaging assembly line.

Thus, there is a need for a case blank feed device that is capable of effectively operating with a large stack of case blanks.

There is a further need for a case blank feed device that decreases the friction along the stack support as the bottom case blank is removed from a stack of case blanks.

There is yet a further need for a case blank feed device that more efficiently removes the bottom blank from a stack of blanks.

There is still a further need for a blank feed device that allows for an increased load of case blanks to be contained within the device while maintaining an effective blank removal process.

SUMMARY OF THE INVENTION

The present invention solves the above-described needs by providing an improved case blank feed device. The structure of the device is designed to reduce friction during removal of the bottom blank from the stack of blanks. Moreover, the present device is more efficient and experiences fewer jamming problems than previous devices. The present invention employs a pair of rotatably mounted, spaced apart bars on which rests a stack of case blanks. During removal of the bottom blank from the stack of blanks, the bars rotate and thus decrease the friction associated with the removal of the bottom blank and decrease the force required for removal. In addition, the present blank feed device uses a vacuum force and concentrates the force to areas close to the bars on which the blank rests. This feature provides more efficiency in removing a blank from the bars thus alleviating any jamming, thereby allowing the entire packaging process to operate at an increased speed.

Thus, it is an object of the present invention to provide a case blank feed device that operates effectively with a large stack of case blanks contained within the device.

It is a further object of the present invention to decrease the friction associated with the removal of the bottom blank from a stack of blanks.

It is yet a further object of the present invention to minimize the time required to remove the bottom blank from a stack of blanks.

It is still a further object of the present invention to effectively remove case blanks from a stack of blanks while containing a large load of blanks within the device.

Other objects, features and advantages of the present invention will become apparent upon reading the following detailed description of the embodiment of the invention, when taken in conjunction with the drawing and appended claims.

BRIEF DESCRIPTION OF THE DRAWINGS

The invention will now be described with reference to the accompanying drawings, which illustrate a preferred embodiment of the case blank feed device, falling within the scope of the appended claims and in which:

DETAILED DESCRIPTION OF THE PREFERRED EMBODIMENT

Figure 1:
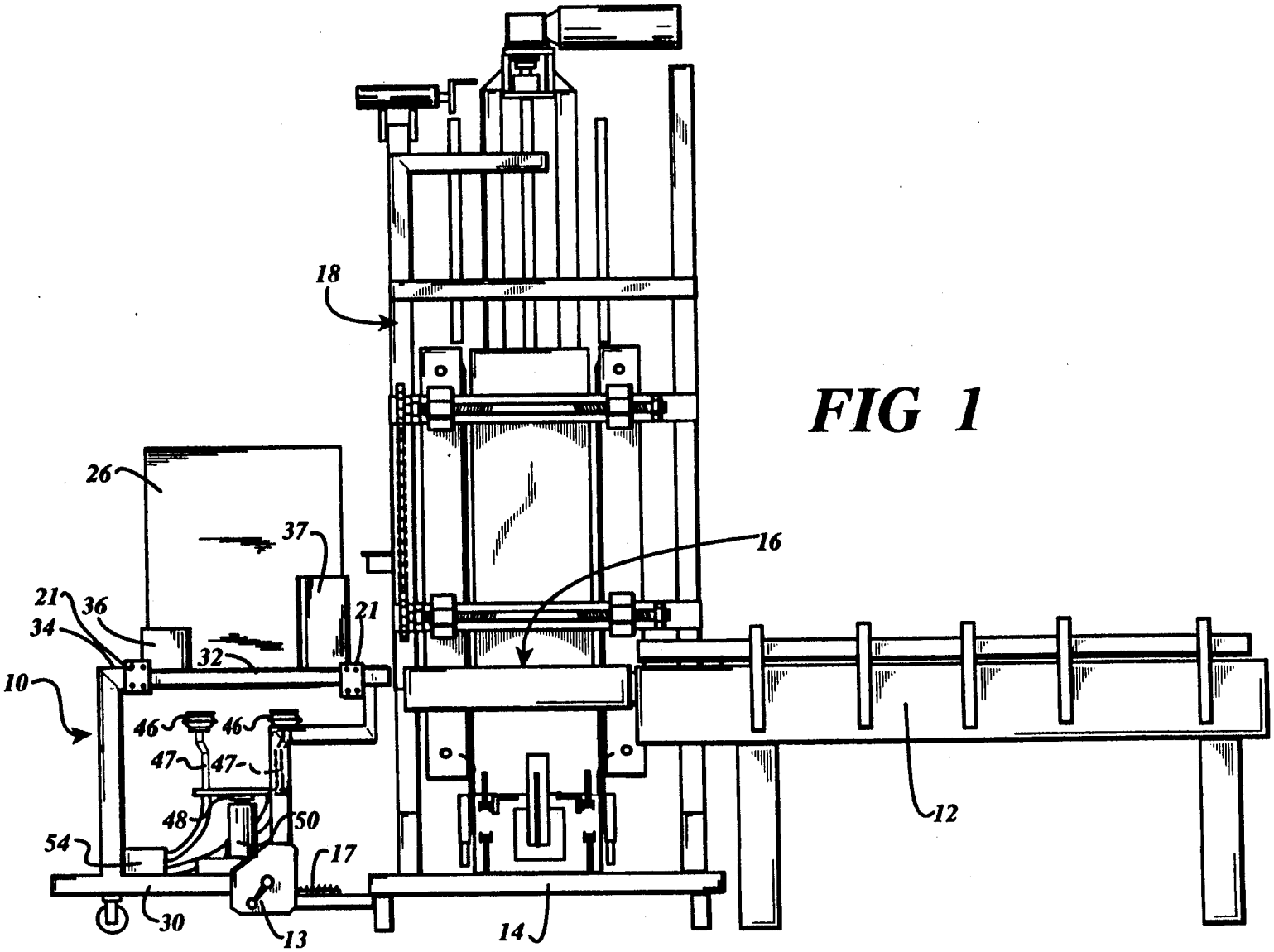
FIG. 1 is an overall perspective view of the case blank feed device as it is associated with other machinery used in a case packaging assembly.
Figure 2:
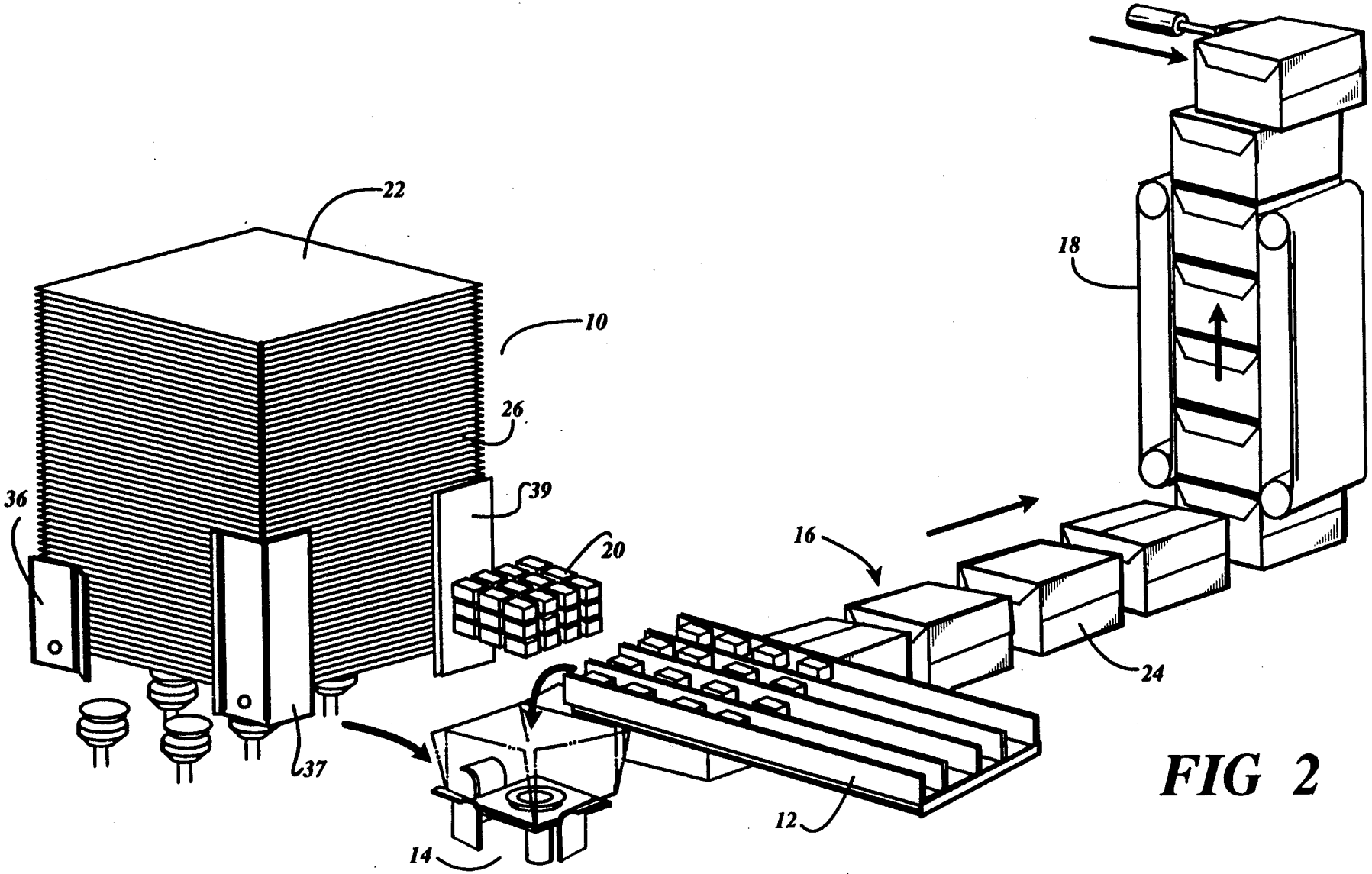
FIG. 2 is an exploded perspective view of the case blank feed device and other machinery used in a case packaging assembly.

Referring now in more detail to the drawing, in which like numerals indicate like parts throughout the several views, FIGS. 1 and 2 show the case blank feed device 10 of the present invention in association with other machines used in a packaging assembly.

The other case packaging assembly machines include a collator 12, a folding device 14, a case advance section 16 and a compression tower 18. As shown in FIG. 2, the collator 12 sorts and feeds items 20 into the folding device 14. The case blank feed device 10 transfers a single case blank 22 to the folding device 14 where the blank receives the packaged items 20 advanced from the collator 12. The folding device 14 partially folds the case blank 22 around the items 20 so as to form a case 24 and then moves the case to the case advance section 16 where adhesive is applied to the case and final folding is complete. The case advance section 16 advances the case 24 to the compression tower 18. The compression tower 18 forces the case 24 into the bottom of a stack 26 of cases. The weight of the stack 26 compresses the case 24. When the case 24 reaches the top of the compression tower 18, the tower advances the case typically by means of a conveyor (not shown) to a palletizer (not shown) where the cases are stacked and prepared for shipping.

Figure 3:
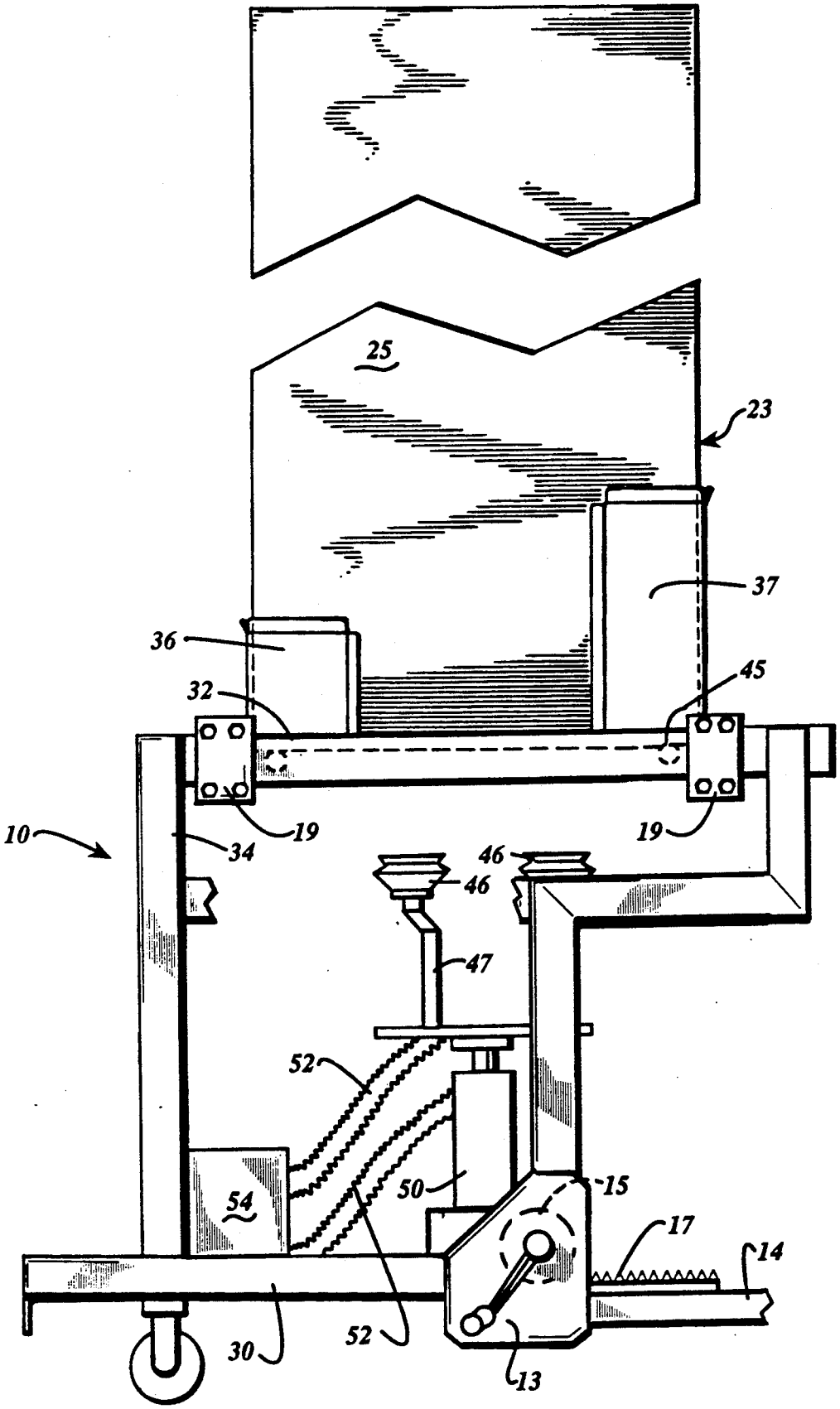
FIG. 3 is a side view of the preferred embodiment.

Turning now to FIG. 3, the blank feed device 10 is shown in greater detail. For alignment purposes, the blank feed device 10 is secured to the folding device 14 by means of a rack and pinion assembly 13. This arrangement enables the blank feed device 10 to remain centrally aligned with the folding device while allowing the blank feed to maintain its adjustability to the folding device 14 when blank sizes differ. The rack and pinion assembly 13 includes a pinion 15 fixed to the base 30 of the blank feed device 10 and rack 17 fixed to the folding device 14.

Figure 4:
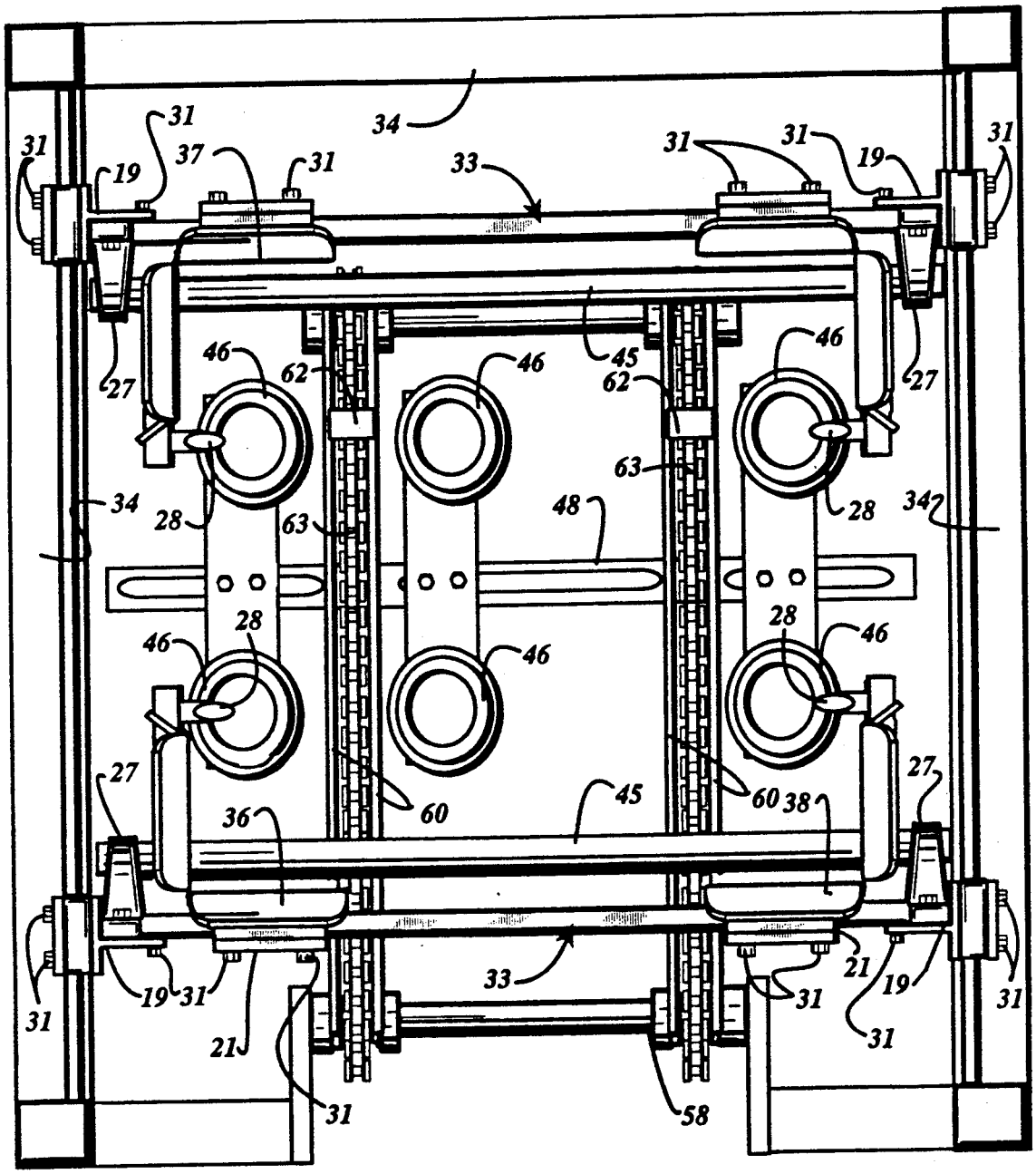
FIG. 4 is a top view of the preferred embodiment.
Figure 4A:
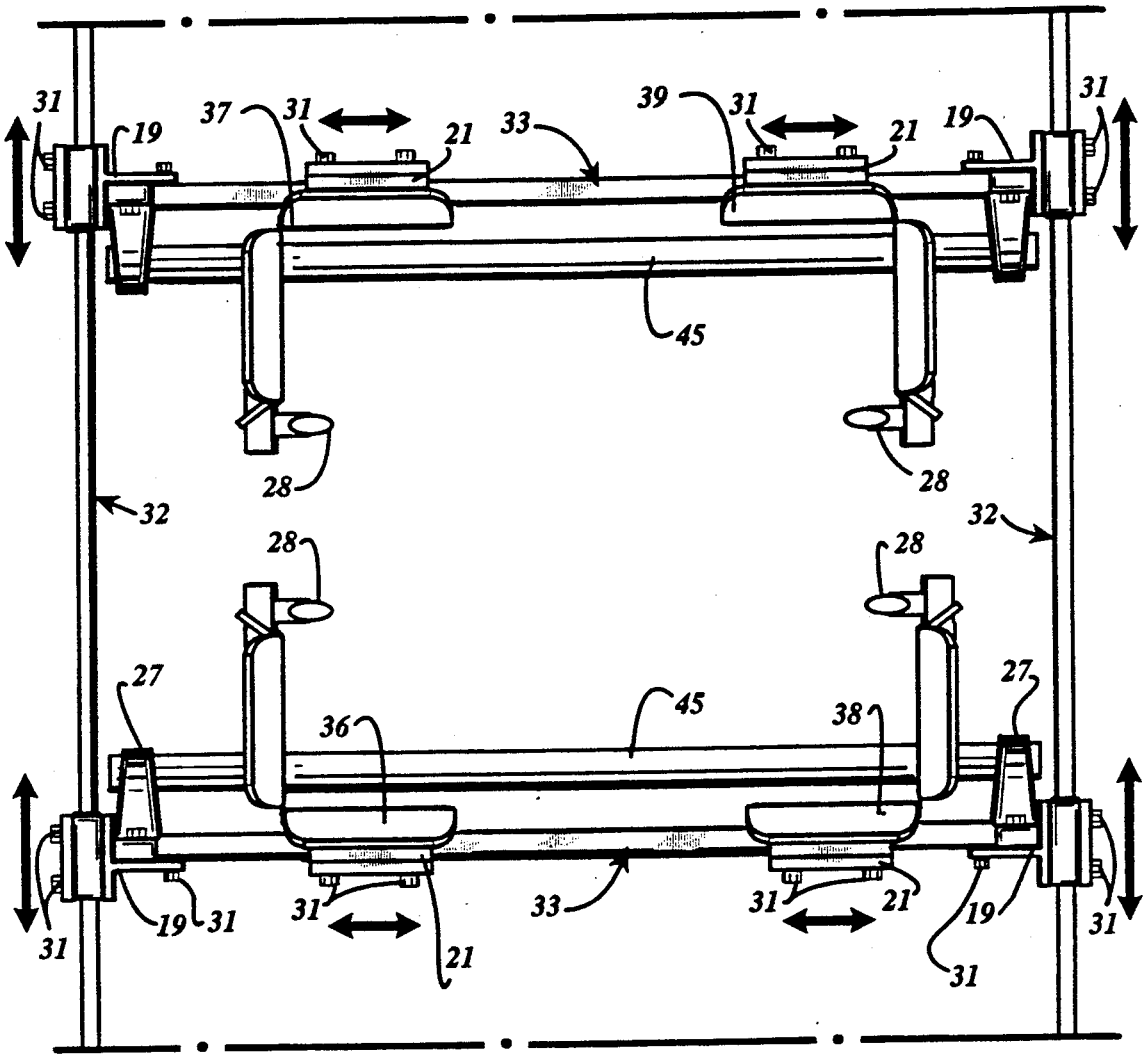
FIG. 4A is a top view of the blank feed container of the preferred embodiment.
Figure 5:
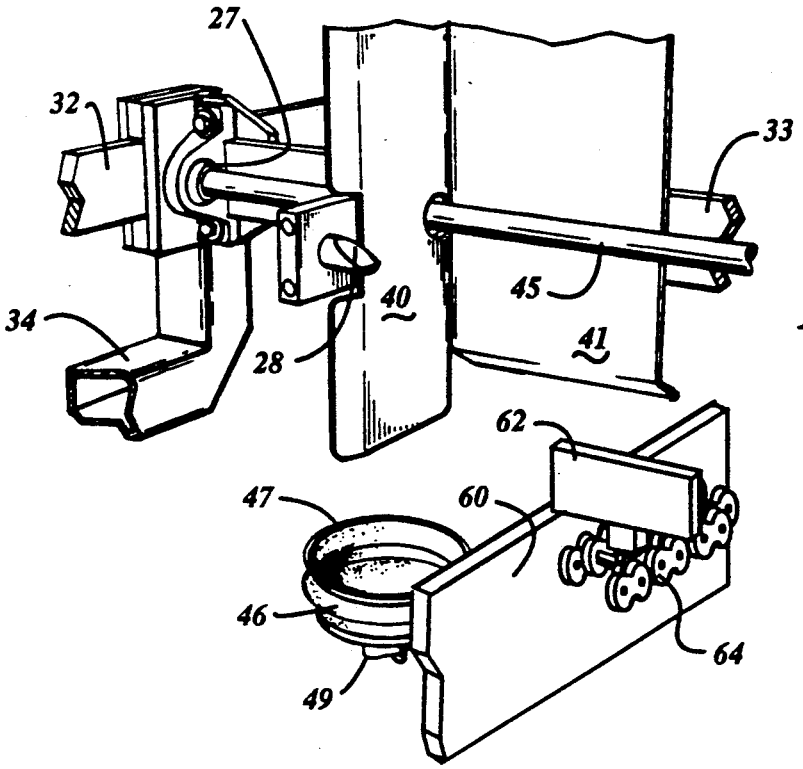
FIG. 5 is a detailed view of the mounting structure for the bar.

The top of the base 30 of the blank feed device 10 forms a hollow rectangle which forms the bottom of a case blank container frame 34. FIGS. 4 and 4A provide a more detailed view of the blank feed container. Two parallel sides 32 of the frame 34 are fixed to the base 30, while the other two parallel sides 33 are slidably mounted to the fixed sides 32 by means of slide clamps 19 and mounting bolts 31. On the two slidably mounted sides 33 of the container frame 34 are mounted four angled pieces 36, 37, 38, 39. The pieces 36, 37, 38, 39 are slidably mounted to the sides 33 by means of slide plates 21 and mounting bolts 31. The ability of the pieces to be slidably mounted accommodates for changes in blank dimensions. Each piece is made up of two plates 40, 41 that are perpendicular to each other. The plates 40, 41 are also angled at the top and bottom. This eases the loading and removal of blanks 22 within the container. The pieces are positioned in such a way that the perpendicular angles formed by the plates 40, 41 face inward toward the center of the container frame 34, as best shown in FIG. 5.

To prevent bowing in the center of the stack 26, additional beveled tabs 28 may also be used to support heavier stack loads. The beveled tabs 28 may be rigidly or rotatably mounted to the slidably mounted sides 33, as shown in FIG. 5. Rigidly mounted tabs 28 do not interfere with the decreased friction associated with the present invention. The area in which the tabs 28 contact the blank 22 is minimal and does not adversely effect the function of the device.

Two of the pieces 37, 39 positioned parallel to each other are greater in height than the other two 36, 38, as shown in FIG. 3. The difference in height between the pieces is designed to ease the loading of the case blanks 22. As the blanks 22 are loaded into the container frame 34, the edges of the blanks 23 hit the higher pieces 37, 39 first and align themselves within the stack of blanks 25.

A pair of parallel, spaced-apart round bars 45 are rotatably mounted to the slidably mounted sides 33 by means of rollers 27. The bars 45 are positioned such that they are parallel to the slidably mounted sides 33 and mounted in such a way that two parallel edges of the blanks 22 will rest on the bars when stacked within the container frame.

Figure 6:
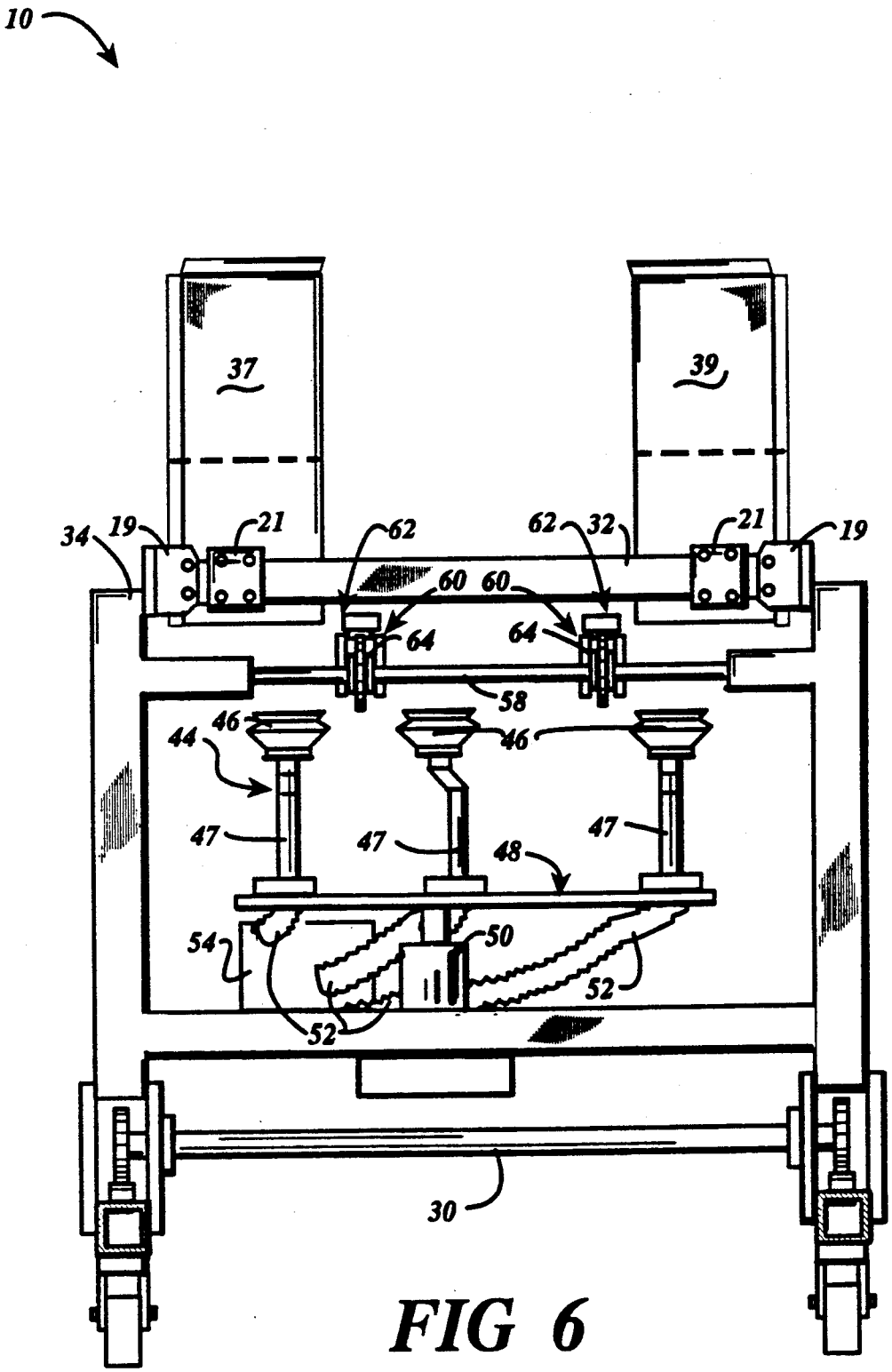
FIG. 6 is a side view of the vacuum assembly.

FIG. 6 shows the vacuum assembly 44 located below the container frame 34. A detailed view of the vacuum assembly is provided in FIG. 4B. The vacuum assembly 44 includes six bellows-shaped suction cups 46 mounted to adjustable stems 47 which are mounted in pairs to stem plates 49 which are mounted to a slotted bar 48. The stems 47 are angled so as to provide an eccentric mount for the cups 46. The slotted bar 48 is mounted on an air cylinder 50 capable of providing reciprocal vertical motion to the slotted bar 48.

A tube 52 is connected to each stem 47. The other end of the tube 52 is connected to a vacuum 54. The tube 52 provides a vacuum force to the suction cup 46. The suction cups 46 are positioned upward near the sides of the container frame 34 that are parallel and proximate to the bars 45.

Figure 4B:
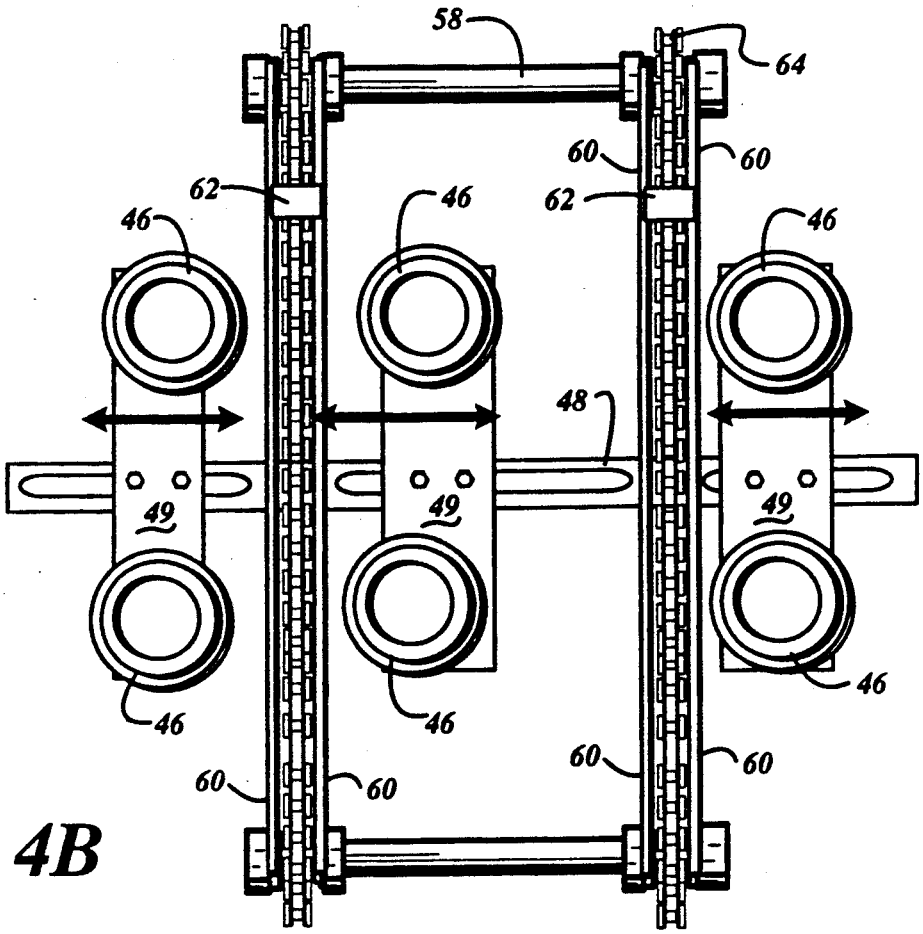
FIG. 4B is a top view of the vacuum and carriage assemblies of the preferred embodiment.

A case blank carriage assembly 58, shown in FIGS. 4B, 5 and 6, is also positioned below the container frame 34. The case blank carriage assembly 58 includes a pair of parallel and spaced apart rails 60, and a pair of lugs 62 secured to a chain mechanism 64 having a continuous chain 63. The rails 60 of the carriage assembly 58 receive the blank 22 after it is removed from the stack 26 and the lugs 62 and chain mechanism 64 advance the blank to the folding device 14.

In operation, the stack 26 of flat pre-cut case blanks 22 is placed into the container 34 of the case blank feed device 10. The case blanks 22 are held stationary by the angled pieces 36, 37, 38, 39. The stack 26 of case blanks 22 is supported by the pair of roller bars 45. The air cylinder 50 which supports the slotted bar 48, stem plates 49, stems 47 and suction cups 46 begins to move vertically upward until it is in its fully extended position. As the slotted bar 48 begins its upward travel, it passes a sensor (not shown) which activates a switch which sends a signal to activate the vacuum 54. As the air cylinder 50 becomes fully extended, the suction cups 46 contact the bottom surface of the bottom blank 22. The air cylinder 50 then begins to retract vertically downward. As it descends, the suction cups 46 remain in contact with the bottom blank 22. As the vacuum force is applied, the blank 22 begins to deflect along the edges of the blank that contact the roller bars 45. The deflection of the blank causes the roller bars 45 to rotate inward toward the center of the blank 22. The rotation of the roller bars 45 makes it easier for the bottom blank edges 23 contacting the roller bars 45 to slip out from the bottom of the stack 26.

After the bottom blank 22 has cleared the roller bars 45 and any beveled tabs 28, the suction cups 46 maintain a vacuum force on the blank 22 as the slotted bar 48 continues its downward travel. Before the blank 22 rests on the carriage assembly rails 60, the slotted bar 48 passes another sensor which deactivates the vacuum 54. Once the blank is resting on the carriage assembly rails 60, the slotted bar 48 continues to descend until the air cylinder 50 returns to its fully retracted position. The vacuum force is shut off from the suction cups 46 before the cups lose contact with the blank 22 so that the surface of the suction cups 51 is not worn prematurely by movement of the blank during separation. Moreover, the cups 46 are bellows-shaped to accommodate any differences in the flatness of the bottom blank 22 as the cups make contact with blank.

Once the blank 22 is resting on the carriage assembly rails 60, a chain mechanism 64 within the carriage assembly 58 is activated causing the chain 63 to move so as to cause the lugs 62 to move toward the blank 22 and continue movement in the same direction toward the folding device 14. As the chain 63 moves, the lugs 62 contact one edge of the blank 22. As the chain 63 travels, the lugs 64 cause the blank 22 to move into position within the folding device 14.

It will be appreciated that the embodiment discussed above is the preferred embodiment, falling within the scope of the appended chains, and that various alternative embodiments are contemplated. For example, the rigid structure used to contain the case blanks may be altered. Alternative vacuum assemblies and carriage assemblies are also contemplated.

I claim:

1. A blank feed assembly comprising:

a means for containing a plurality of vertically stacked case blanks;

an open area located along the underside of the containing means;

a pair of parallel and spaced apart bars rotatably mounted to the containing means across the underside of the containing means and proximately close to a pair of parallel edges of the containing means on which rests the stack of blanks, the bars are circular in cross-section and the bars are mounted so as to enable the bars to rotate freely; and a plurality of cup-shaped members for applying a suction force along the underside of the containing means, the cup shaped members being aligned proximate to the edges of the blank that are in contact with the bars.

2. The device of claim 1 wherein the containing means comprises a frame and vertically oriented L-shaped braces slidably mounted to the frame to accommodate changes in blank dimensions.

3. A blank feed assembly comprising:

a means for containing a plurality of vertically stacked case blanks;

an open area located along the underside of the containing means;

a pair of parallel, freely rotatable bars mounted to opposite edges of the containing means;

a plurality of cups for applying a suction force along the underside of the containing means and arranged proximate to the bars that are in contact with the blank edges; and a means for providing reciprocal vertical movement to the plurality of cups.

4. The device of claim 3 wherein the containing means comprises a frame and vertically oriented L-shaped braces slidably mounted to the frame to accommodate changes in blank dimensions, the braces being angled at the bottom on one side.

5. The device of claim 3 wherein the cups are bellows-shaped.

6. A blank feed assembly comprising:

a means for containing a plurality of vertically stacked case blanks;

an open area located along the underside of the containing means;

a pair of parallel, spaced apart and freely rotatably bars mounted to the containing means across the underside of the containing means and proximately close to a pair of parallel edges of the containing means on which rests the stack of blanks; and a plurality of suction cups facing the underside of the stack of blanks;

a means for supplying the plurality of suction cups with a vacuum; and a means for providing the plurality of suction cups with reciprocating vertical motion, whereby the plurality of suction cups moves vertically upward to contact the bottom blank in the stack of blanks, the vacuum holds the blank to the plurality of cups, the plurality of cups then moves vertically downward to cause the bottom blank to pass through the pair of rotating bars and be removed from the bottom of the stacks of blanks.

7. The device of claim 6 wherein the containing means comprises a frame and vertically oriented L-shaped braces slidably mounted to the frame to accommodate changes in blank dimensions.

8. A method for separating a single case blank from the bottom of a stack of blanks comprising the steps of:

containing a plurality of vertically stacked case blanks;

providing an open area at the bottom of the vertically stacked case blanks;

arranging a pair of parallel, spaced apart, freely rotating bars in the open area of the bottom of the stack of case blanks such that the bars support parallel edges of the stack of case blanks proximate to the length of the bars;

applying a plurality of suction cups to the underside of the stack of case blanks proximate to the length of the bars;

supplying a vacuum to the plurality of suction cups;

providing upward vertical motion to the plurality of suction cups sufficient to cause the plurality of suction cups to contact the underside surface of the stack of case blanks; and providing downward vertical motion to the plurality of suction cups causing the bottom most case blank to pass through the parallel bars and to be removed from the stack of case blanks.

* * * * *